US008904830B2

(12) United States Patent
Finke et al.

(10) Patent No.: US 8,904,830 B2
(45) Date of Patent: Dec. 9, 2014

(54) FRONT-LOADING LAUNDRY APPLIANCE HAVING A STEAM GENERATOR DEVICE

(75) Inventors: Michael Finke, Hoevelhof (DE); Hartmut Linnemann, Rheda-Wiedenbrueck (DE); Robert Muether, Rheda-Wiedenbrueck (DE); Dirk Sieding, Luenen (DE)

(73) Assignee: Miele & Cie. KG, Guetersloh (DE)

( * ) Notice: Subject to any disclaimer, the term of this patent is extended or adjusted under 35 U.S.C. 154(b) by 677 days.

(21) Appl. No.: 12/140,495

(22) Filed: Jun. 17, 2008

(65) Prior Publication Data

US 2008/0314092 A1 Dec. 25, 2008

(30) Foreign Application Priority Data

Jun. 19, 2007 (DE) ..... 10 2007 028 617

(51) Int. Cl.
*D06F 37/00* (2006.01)
*D06F 39/08* (2006.01)
*D06F 39/00* (2006.01)

(52) U.S. Cl.
CPC ..... *D06F 39/008* (2013.01); *D06F 39/085* (2013.01); *D06F 39/088* (2013.01)
USPC ..... 68/5 C

(58) Field of Classification Search
USPC ..... 68/5 C, 5 R
See application file for complete search history.

(56) References Cited

U.S. PATENT DOCUMENTS 3,266,274 A * 8/1966 Schwing ..... 68/18 FA
3,670,141 A * 6/1972 Dines ..... 392/402
4,613,071 A * 9/1986 Omori ..... 237/9 R
4,724,824 A * 2/1988 McCoy et al. ..... 392/396
2004/0237603 A1 12/2004 Kim et al.
2006/0277690 A1* 12/2006 Pyo et al. ..... 8/149.2
2008/0000098 A1 1/2008 Choi et al.

FOREIGN PATENT DOCUMENTS

DE 103 32 656 A1 7/2004
DE 10 2005 051721 A1 5/2007
DE 102007007354 10/2007
EP 1 529 875 A2 5/2004
EP 1464751 10/2004
EP 1 507 030 A1 2/2005
EP 1659205 5/2006
EP 1 862 575 A1 12/2007
JP 2004321918 A * 11/2004
KR 100662473 12/2006

OTHER PUBLICATIONS

Machine Translation of Sha et al., JP 2004-321918 A, Nov. 2004.*
European Search Report for EP 08 01 0250, dated Nov. 15, 2010.

* cited by examiner

*Primary Examiner* — David Cormier
(74) *Attorney, Agent, or Firm* — Leydig, Voit & Mayer, Ltd.

(57) ABSTRACT

A front-loading laundry appliance including a housing with a substantially circular housing opening and a door configured to close the housing opening. A substantially cylindrical container is disposed in the housing and is configured to receive laundry for treatment. The substantially cylindrical container has a substantially circular container opening. The laundry appliance also includes a steam generator with a heating element, an inlet opening and a common outlet opening for water and steam. A pump is configured to deliver water to the inlet opening of the steam generator. A nozzle is disposed in an edge region of the container opening and configured to inject water and steam into the interior of the container.

8 Claims, 1 Drawing Sheet

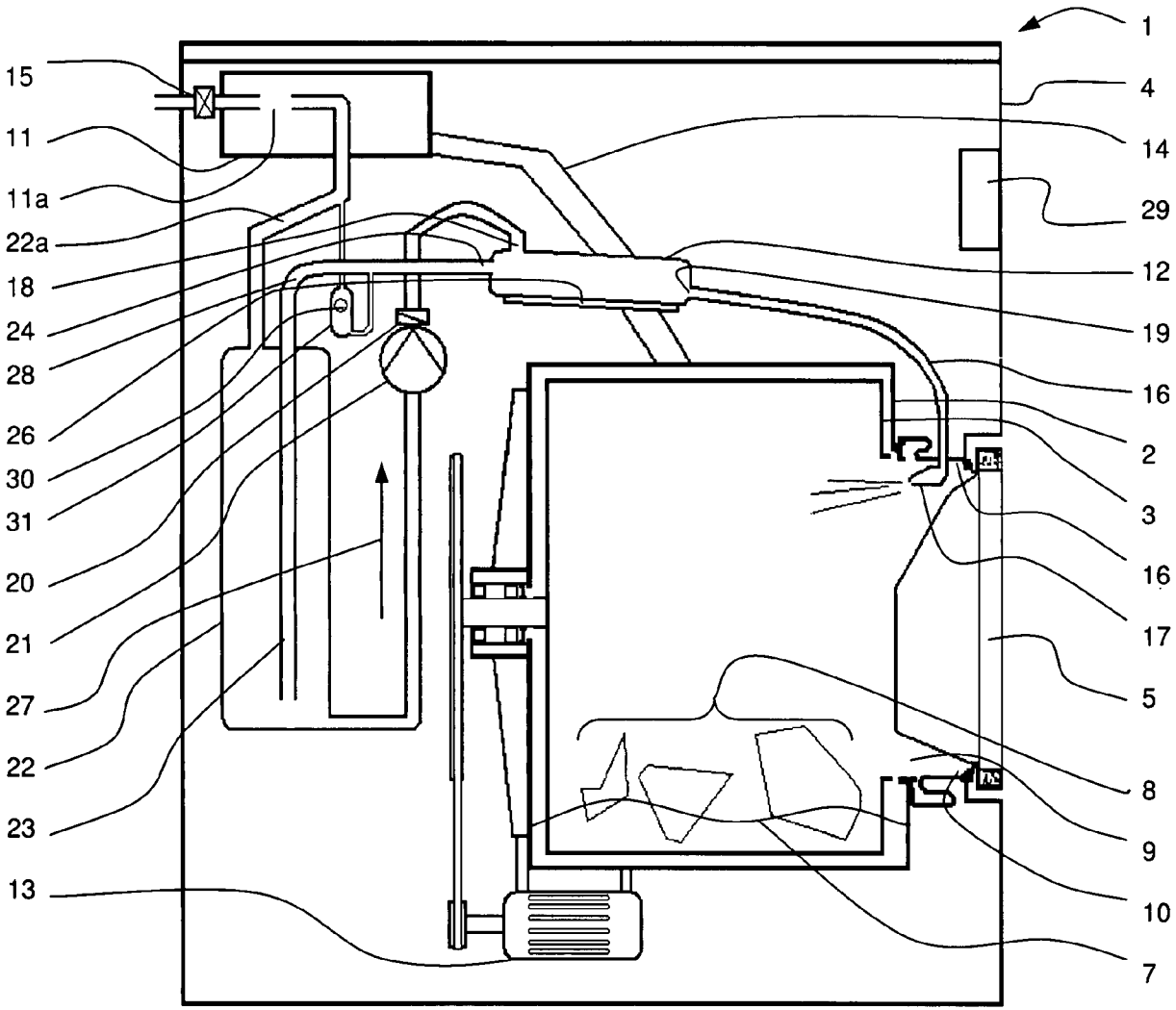
1
4
14
29
12
19
16
2
3
16
17
5
8
9
10
7
15
11
11a
22a
18
24
28
26
30
31
20
21
27
22
23
13

FRONT-LOADING LAUNDRY APPLIANCE HAVING A STEAM GENERATOR DEVICE

CROSS REFERENCE TO RELATED APPLICATIONS

Priority is claimed to German patent application DE 10 2007 028 617.3, filed Jun. 19, 2007, which is hereby incorporated by reference herein.

FIELD

The invention relates to a front-loading laundry appliance with a device used for generating steam.

BACKGROUND

European Patent Document EP 1 659 205 A2 describes a front-loading washing machine including a suds container for receiving wash liquid and the laundry to be treated. The washing machine also includes a steam generator which has a tank for receiving the liquid to be evaporated and a heating element for heating and evaporating said liquid. The washing machine further includes a means for spraying or introducing water into the suds container, said means having a nozzle in the edge region of the door opening. This washing machine is provided with a separate nozzle for admission of water, and a further nozzle or tube end for the steam, the supply lines passing through the bellows seal. Access to the interior of the suds container is somewhat impaired by the two separate nozzles disposed in the region of the door opening. Separate controllable valves are respectively provided for the supply line, for the outlet opening, for the steam and for the outlet openings for the water, which results in a rather complex arrangement.

European Patent Document EP 1 464 751 A1 describes a washing machine having a suds container for receiving wash liquid and the laundry to be treated. The washing machine described therein includes a steam generator used for steaming the laundry. Here, the washing machine is provided in its upper portion with a container into which a predetermined amount of water is introduced. A heating element heats the liquid until it evaporates. The steam is passed through a conduit and a nozzle into the treatment chamber, i.e., into the interior of the drum. Moreover, water can be passed into the interior of the drum through the same conduit and nozzle. The inlet is directly connected to the water supply and is controlled by a valve. Similarly, a discharge valve controls the discharge of steam so as to provide sufficient steam pressure within the steam generator device. When the discharge valve is opened, a large quantity of steam is discharged because of the high pressure, as a result of which droplets are carried out of the container. However, during treatment of laundry with steam, droplets are not desired because they result in non-uniform wetting of the laundry.

SUMMARY

An aspect of the present invention is to provide an improved laundry appliance having a steam generator device.

In an embodiment, the present invention provides a front-loading laundry appliance including a housing with a substantially circular housing opening and a door configured to close the housing opening. A substantially cylindrical container is disposed in the housing and is configured to receive laundry for treatment. The substantially cylindrical container has a substantially circular container opening. The laundry appliance also includes a steam generator with a heating element, an inlet opening and a common outlet opening for water and steam. A pump is configured to deliver water to the inlet opening of the steam generator. A nozzle is disposed in an edge region of the container opening and configured to inject water and steam into the interior of the container.

BRIEF DESCRIPTION OF THE DRAWINGS

An exemplary embodiment of the present invention will be described in more detail below and is shown in a purely schematic way in the drawing, in which:

FIG. 1 is a schematic cross-sectional view of a laundry appliance having a steam generator device.

DETAILED DESCRIPTION

In an embodiment, the present invention is for a laundry appliance including a housing, a substantially circular housing opening which is closable by a door, a substantially cylindrical container which is disposed within the housing and used for receiving the laundry to be treated and which has a substantially circular container opening, and further including a nozzle for introducing water, and a device used for generating steam and including a tank, a heating element, an inlet opening and a common outlet opening for water and steam, said water and said steam being injectable into the interior of the container through a nozzle disposed in the edge region of the container opening.

In the laundry appliance of the present invention the steam may be generated in a predefined manner. For example, the steam may be introduced into the treatment chamber and onto the laundry to be treated in a uniform manner or in bursts. Moreover, the laundry appliance of the present invention makes it possible to very accurately meet the timing requirements for the steam injection, thereby allowing for precise interaction with a wash cycle or drying cycle in progress.

In accordance with an embodiment of the present invention, a pump delivers the water to the inlet opening of the steam generator device. The pump allows for accurate adjustment of a continuous flow of water to the steam generator, allowing it to perform evaporation in a substantially uniform manner. Alternatively, the pump can be used to produce bursts of steam in a controlled manner in order, for example, to inject steam at high pressure into the drum or treatment chamber during short periods of time. Unlike admission through a valve, the pump also allows the amount of water introduced into the steam generator to be independent of the water pressure. The delivery rate of the pump is advantageously controlled by the appliance controller, which may control the sequence of the wash cycle or drying cycle.

When using the steam generator device in a washing machine including a suds container resiliently mounted in the housing and having a rotatable drum disposed in a horizontal or inclined position therein and further having a substantially circular suds container opening, the washing machine further including a bellows seal disposed between the housing opening and the suds container opening to provide a connection therebetween, the nozzle for introducing water and injecting steam may be mounted in the bellows seal. This allows laundry to be uniformly and reliably treated with steam coming from the loading opening, particularly when the nozzle is mounted in the upper region of the sealing ring or of the loading opening of the drum. All directions are given relative to the laundry appliance in its upright position of use.

In an embodiment of the invention, the laundry appliance includes at least one tank capable of storing the water that can be delivered by the pump to the inlet opening of the steam generator device. In this manner, a limited amount of water to be evaporated is kept available.

In order to prevent, to the extent possible, residual water from remaining in the steam generator device, the steam generator device, or at least the inner bottom, may be positioned in such a manner that it slopes downward toward the outlet opening. Water which passes through the steam generator device during door glass inflow is at least nearly completely discharged from the steam generator device. This prevents the formation of lime and other deposits, or causes such deposits to be flushed away.

In an embodiment, the pump is provided with a check valve for the water to be delivered to the steam generator device. This prevents the pressure generated during evaporation from escaping through the pump. This is advantageous when producing steam bursts, because after the short period of water inflow and turning off of the pump, a high pressure develops within the steam generator device.

In order to suitably treat the laundry with steam, the pump may have a delivery of 2 to 7 ml per second, if the nozzle has a cross-sectional area of 0.5 $cm^2$ to 1 $cm^2$, and if the heating element has a maximum power of 1 kW. Moreover, to be able to store a relatively large amount of heat (here about 5 kW) with this low heating power, an aluminum block can be included that has a weight of 300 to 800 g, which is heated by the heating element to a temperature of 120 to 200° C. The tank can have a volume in the range from 300 ml to 1000 ml. With these dimensions, an amount of steam sufficient for a normal load of laundry of 3 to 6 kg can be generated using little electrical power.

In a suitable embodiment, a dip tube is inserted in the tank, the dip tube connecting to a further inlet opening of steam generator device via a connecting conduit bypassing the pump. This bypass conduit provides an overflow via which water flowing over from the tank is directed through the steam generator device and then through the conduit to the nozzle, from where it is introduced into the interior of the drum. Thus, only the inlet valve is opened during the introduction of water, whereby the steam generator container is caused to overflow. After the inlet valve is closed, the amount of water to be stored remains in the tank, while a residual amount of water flows out of the tank until the level of the nozzle is reached.

In order for the water to completely, or at least nearly completely, flow out of the conduits and the steam generator device, an embodiment provides for venting of the steam generator device. Venting is accomplished by a siphon disposed between the upper portion of the connecting conduit and the inlet conduit. Thus, air can flow via the flow gap into the conduit and further into the steam generator device.

In an embodiment, the siphon has a ball float disposed therein, said ball float acting as a valve allowing the siphon to be closed by the steam pressure. Thus, during steam generation, steam may be prevented from escaping through the vent.

FIG. 1 illustrates, in a purely schematic way, a laundry appliance 1, here a washing machine, having a suds container 2. Positions and directions are given relative to the laundry appliance in its upright position of use. A drum 3 driven by an electric motor 13 is rotatably mounted within suds container 2, said drum moving the laundry 8 present in suds container 2, i.e., in drum 3. In this embodiment, drum 3 is made of stainless steel and provided with a plurality of openings permitting flow therethrough. The wash liquid 7 required for the cleaning or treatment of laundry 8 is present in the lower portion of suds container 2. The warming or heating of liquid 7 is accomplished by a heating element disposed in the lower region of suds container 2. An inlet valve 15 is indicated in the upper portion of appliance 1, said inlet valve controlling the introduction of water from the water supply system. Water is introduced into suds container 2 through dispensing compartment 11 and connecting tube 14. In the process, detergent which has been filled into dispensing compartment 11 is washed into suds container 2. In addition, laundry appliance 1 has a device 12 for generating steam which is injected into the interior of suds container 2, i.e., into the interior of drum 3, via a conduit 16 and a nozzle 17 connected thereto. Nozzle 17 is mounted in the upper region of a bellows seal 6 which provides the connection between opening 9 in suds container 2 and opening 10 in housing 4, which can be closed by door 5.

The laundry appliance includes a pump 21 to deliver water 27 to the steam generator device 12, said pump having a check valve 20 provided on its pressure side for the water 27 to be pumped. The check valve prevents steam generated in steam generator device 12 from escaping through opening 18 and flowing back through pump 21.

Connected to outlet opening 19 is a conduit 16 through which the steam or water to be introduced is passed to nozzle 17. Nozzle 17 is mounted at the edge of opening 9 in the treatment chamber in the upper portion thereof, here in the region of bellows seal 6, and is directed toward the interior of suds container 2 so as to effectively spray steam onto laundry 8 present in suds container 2, i.e., in drum 3. A controller 29 controls the operations to be performed during a laundry treatment or wash cycle and during the generation of steam, such operations including, in particular, the control of inlet valve 15, of heating element 26, and of pump 21.

Pump 21 draws the water 27 to be pumped from a tank 22, which is filled through the controllable inlet valve. In order to ensure compliance with hygiene requirements, a flow gap 11*a* is provided between inlet valve 15 and tank 22 and inlet conduit 22*a*, in the area of dispensing compartment 11. Furthermore, a dip tube 23 is inserted in tank 22, said dip tube bypassing pump 21 and connecting via conduit 28 directly to a further inlet opening 24 of steam generator device 12. This bypass provides an overflow via which water flowing over from tank 22 is directed through dip tube 23 and connecting conduit 28 to steam generator device 12, and then through conduit 16 to nozzle 17, from where it is introduced into the interior of drum 3. Upon closure of inlet valve 15, a portion of water 27 flows out from the tank until it reaches the level of nozzle 17. In an embodiment, steam generator device 12 is mounted such that it slopes downward toward outlet opening 19, so that it is at least nearly completely emptied and thereby flushed, thus preventing, or at least reducing, the formation of lime and dirt deposits in steam generator device 12. In order for the water to reliably and completely flow out of steam generator device 12 and conduit 28, additional provision is made for venting of this conduit 28. For this purpose, a siphon 31 is disposed between the upper portion of the connecting conduit, said siphon being connected to inlet conduit 22*a* and allowing air to flow via flow gap 11*a* into conduit 28 when the inflowing water is cut off, i.e., when inlet valve 15 is closed. Siphon 31 has disposed therein a ball float 30 which, during steam generation, is pressed against the upper inlet opening of siphon 31 by the pressure developing in the process, thereby preventing steam from escaping through siphon 31, i.e., through the venting channel.

During steam generation, the dip tube prevents steam from escaping through further inlet opening 24; this arrangement acting as a further siphon allowing steam to flow back into tank 22 in the event of excessive pressure. This arrangement provides a pressure relief valve which prevents excessive pressure in steam generator device 12.

Instead of a washing machine, the laundry appliance 1 used may also be a dryer which contains a rotatable drum 3, but in which there is no suds container 2 and no bellows seal between suds container 2 and the housing opening. Here, nozzle 17 is disposed in the edge region of the housing opening to allow the steam to be injected into the interior of drum 3.

What is claimed is:

1. A front-loading laundry appliance comprising:

a housing including a substantially circular housing opening;

a door configured to close the housing opening;

a substantially cylindrical container disposed in the housing and configured to receive laundry for treatment, the substantially cylindrical container including a substantially circular container opening;

a first fluid path for delivering water into the substantially cylindrical container, the first fluid path including:

a dispensing compartment, and a connecting tube between the dispensing compartment and the cylindrical container;

an alternate fluid path for delivering water and steam into the substantially cylindrical container, the alternate fluid path including:

a steam generator including a heating element, an inlet opening and a common outlet opening for water and steam;

a pump configured to deliver water to the inlet opening of the steam generator;

a nozzle disposed in an edge region of the container opening configured to inject water and steam into an interior of the container;

at least one tank configured to store water deliverable by the pump to the inlet opening of the steam generator; and a dip tube disposed in the tank, the dip tube being connected to a further inlet opening of the steam generator by a connecting conduit that bypasses the pump.

2. The front-loading laundry appliance as recited in claim 1 wherein the steam generator includes a venting device.

3. The front-loading. laundry appliance as recited in claim 2 wherein the venting device includes a siphon connected between an upper portion of the connecting conduit and an inlet conduit of the steam generator so as to allow air to flow through a flow gap into the connecting conduit and into the steam generator.

4. The front-loading laundry appliance as recited in claim 3 wherein the siphon includes a ball float disposed therein, the ball float configured to act as a valve so as to close the siphon by steam pressure.

5. A front-loading laundry appliance comprising:

a housing including a substantially circular housing opening;

a door configured to close the housing opening;

a substantially cylindrical container disposed in the housing and configured to receive laundry for treatment, the substantially cylindrical container including a substantially circular container opening;

a steam generator including a heating element, an inlet opening and a common outlet opening for water and steam;

a tank;

a pump configured to deliver supply water from the tank to the inlet opening of the steam generator;

a dip tube disposed in the tank-and connected to a further inlet opening of the steam generator by a connecting conduit that bypasses the pump, the dip tube and connecting conduit being configured to supply additional water to the steam generator from the tank; and a nozzle disposed in an edge region of the container opening configured to inject water and steam into an interior of the container.

6. The front-loading laundry appliance as recited in claim 5 wherein the steam generator includes a venting device.

7. The front-loading laundry appliance as recited in claim 6 wherein the venting device includes a siphon connected between an upper portion of the connecting conduit and an inlet conduit of the steam generator so as to allow air to flow through a flow gap into the connecting conduit and into the steam generator.

8. The front-loading laundry appliance as recited in claim 7 wherein the siphon includes a ball float disposed therein, the ball float configured to act as a valve, so as to close the siphon by steam pressure.

* * * * *